US008381402B2

(12) United States Patent
Grant et al.

(10) Patent No.: US 8,381,402 B2
(45) Date of Patent: Feb. 26, 2013

(54) FUEL INJECTOR TIP AUTOFRETTAGE PROCESS

(75) Inventors: Marion B. Grant, Princeville, IL (US); Petr Michlik, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 719 days.

(21) Appl. No.: 12/628,506

(22) Filed: Dec. 1, 2009

(65) Prior Publication Data

US 2011/0126393 A1 Jun. 2, 2011

(51) Int. Cl.
*B21K 21/08* (2006.01)

(52) U.S. Cl. ..... 29/890.142; 29/890.06; 29/890.143; 29/421.1; 239/533.1; 239/548; 239/567

(58) Field of Classification Search ..... 29/890.06, 29/890.142, 890.143, 421.1; 239/533.1, 239/548, 567

See application file for complete search history.

(56) References Cited

U.S. PATENT DOCUMENTS

| | | | | |
|---|---|---|---|---|
| 2005/0127665 | A1* | 6/2005 | Usui et al. | 285/197 |
| 2012/0238188 | A1* | 9/2012 | Miller | 451/75 |

FOREIGN PATENT DOCUMENTS

| | | | |
|---|---|---|---|
| EP | 1298313 | | 4/2003 |
| EP | 1298313 | A2 | 4/2003 |
| JP | 2009052452 | | 3/2009 |
| JP | 2009052452 | A | 3/2009 |
| WO | 2006089817 | | 8/2006 |
| WO | 2006089817 | A1 | 8/2006 |
| WO | 2008058494 | | 5/2008 |
| WO | 2008058494 | A1 | 5/2008 |

OTHER PUBLICATIONS

Adis Basara PhD, Chapter 4 Evaluation of Fuel Lines Using Speckle Interferometry, 2007, pp. 70-113, Der Technischen Fakultat der Universitat Erlangen-Nurnberg, Germany.

* cited by examiner

*Primary Examiner* — Richard Chang
(74) *Attorney, Agent, or Firm* — Liell & McNeil

(57) ABSTRACT

A production robust autofrettage process for strengthening fuel injector nozzle tips includes applying a vacuum to the interior volume of the nozzle tip. Plugs are suctioned over each of the nozzle outlets. Nozzle outlets are blocked by pressing the plugs between the nozzle tip and a fixture component. The nozzle tip is then autofrettaged at least in part by pressurizing the interior volume with an autofrettage liquid. The plugs are then removed from the nozzle outlets leaving the nozzle tip strengthened with compressive residual stress, especially in the sac region of the interior volume of the nozzle tip.

17 Claims, 2 Drawing Sheets

FUEL INJECTOR TIP AUTOFRETTAGE PROCESS

TECHNICAL FIELD

The present disclosure relates generally to strengthening fuel injector nozzle tips, and more specifically a process for blocking nozzle outlets as part of an autofrettage process.

BACKGROUND

Ever more stringent emissions regulations have driven the compression ignition engine industry to adopt increased fuel injection pressures. One area of concern as a consequence of increased injection pressures relates to potential fatigue in the sac region of the fuel injector nozzle tip component. The sac region is often the thinnest pressure containment metallic layer, and also defines the nozzle outlets that extend between an interior volume of the fuel injector to the combustion space of the engine. The sac region will typically cycle through extreme high pressures with each engine cycle.

One strategy believed to have promise in strengthening fuel system components is to induce compressive residual stress on the inner surface the component. While a number of different strategies are possible for inducing compressive residual stress, an autofrettage process can be effective in inducing compressive residual stress on the interior surfaces of pressure vessels. For instance, Chapter 4 from Adis Basara's PhD. dissertation, Evaluation of High Pressure Components of Fuel Injection Systems Using Speckle Interferometry (2007), teaches sealing one end of a fuel line in order to perform an autofrettage process. Thus, an effective autofrettage process for a fuel injector nozzle tip may require that the nozzle outlets be sealed during the autofrettage pressurization procedure. Because the autofrettage pressures are so high, finding a robust production strategy for nozzle tips in a factory setting can be problematic.

The present disclosure is directed toward one or more of the problems set forth above.

SUMMARY

A method of strengthening a nozzle tip includes applying a vacuum to an interior volume of the nozzle tip. Respective plugs are suctioned over each of a plurality of nozzle outlets during the vacuum application step. Each of the plurality of nozzle outlets is then blocked with one of the respective plugs. The nozzle tip is then autofrettaged at least in part by pressurizing the interior volume with autofrettage liquid.

DETAILED DESCRIPTION

Autofrettage is a means to introduce residual compressive stress to the inside surface of a pressure vessel, and is known to be used in the production of high pressure fuel lines for fuel injection systems. Autofrettaging involves pressurizing the component past the yield strength of the interior material, but below the yield strength for the material closer to the outside diameter of the component. The challenge in such a high pressure hydraulic process is sealing effectively. This disclosure pertains to blocking the injector nozzle outlets for the autofrettage process. It is proposed that microspheres, slightly larger in diameter than the orifices, be sucked onto the opening of each nozzle outlet. These relatively soft microspheres would then be put under mechanical pressure, and possibly deformed, to block the nozzle outlets during the pressurization of the autofrettage process. As used in this disclosure, the term "block" means that fluid flow past the plug is sufficiently low at autofrettage pressures that the autofrettage process in the sac region of the fuel injector leaves satisfactory levels of compressive residual stress.

Figure 1:
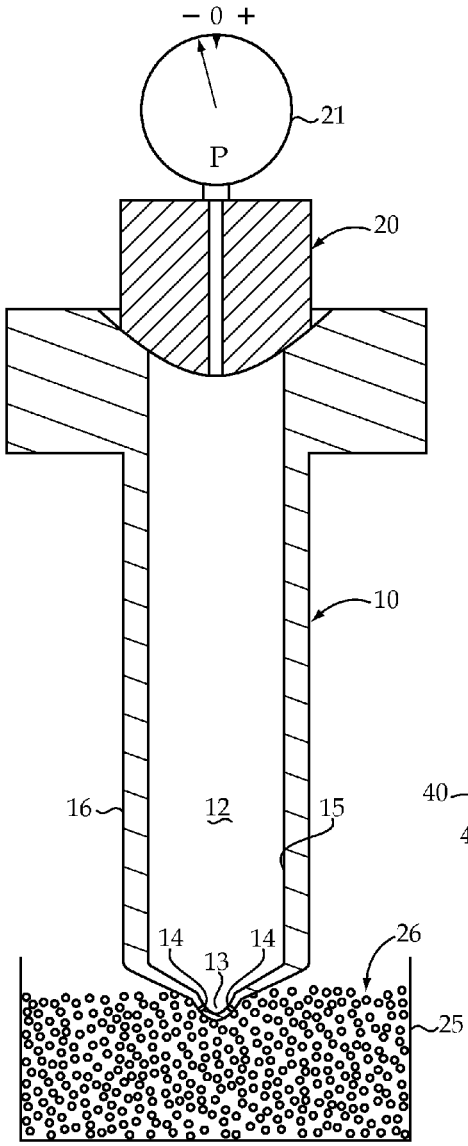
FIG. 1 is a sectioned side view of a nozzle tip with a vacuum applied for suctioning plugs from a vessel.

Referring to FIG. 1, a fuel injector nozzle tip 10 includes a plurality of nozzle outlets 14 that extend between an interior surface 15 and an exterior surface 16. The interior surface 15 defines an interior volume 12, which includes a sac 13. The fuel injector nozzle tip 10 is shown with an attached vacuum component 20, which may or may not include a pressure gauge 21. For purposes of the present disclosure, the pressure gauge 21 is included to show that the vacuum component 20 is applying a vacuum to the interior volume 12 of nozzle tip 10. While the vacuum is being applied, the nozzle tip 10 may be positioned in a vessel 25 containing a multitude of plugs 26. For purposes of the present disclosure, the phrase "applying a vacuum" means that the pressure in interior volume 12 is lower than the pressure acting on exterior surface 16 in the vicinity of nozzle outlets 14 when the nozzle tip 10 is inserted into the vessel 25 of plugs 26.

Plugs 26 may be suspended and/or immersed in any suitable fluid including air or possibly autofrettage liquid. The volume of plugs may be "fluidized" to mobilize the plugs to facilitate their motion to cover each nozzle outlet. In one embodiment, plugs 26 are non-magnetic stainless steel microspheres having a diameter that is greater than the diameter of nozzle outlets 14 where the outlets open through exterior surface 16. Those skilled in the art will appreciate that the autofrettage process of the present disclosure may occur after heat treatment of the fuel injector nozzle tip 10 such that the nozzle outlets 14 open through a convex uncontrolled surface that is a portion of exterior surface 16. Although not necessary, plugs 26 may be made of a material softer than the material of the nozzle tip 10 when undergoing the procedure of the present disclosure. By sizing the microsphere plugs 26 to be greater than the diameter of nozzle outlets 14, the plugs may tend to suction over the nozzle outlets 14 when the vacuum is being applied, rather than being actually drawn into the interior of the nozzle outlets 14. It is believed that sizing the microsphere plugs 26 to have a diameter at least 20% greater than the nozzle outlets 14 but less than two times the diameter the diameter of the nozzle outlets at the exterior surface 16 may work suitably well for the procedure of the present disclosure. Those skilled in the art will appreciate that when nozzle tip 10 is being inserted into vessel 25, the nozzle tip 10 may be held and maneuvered in a suitable manner, such as by a production robotic arm, not shown. Thus, when the nozzle tip is inserted into vessel 25, fluid in and around the plugs 26 will cause individual respective plugs to be suctioned over each of the plurality of nozzle outlets 14. Depending upon circumstances, confirming that plugs have been suctioned over each of the nozzle outlets may be accomplished by, for instance, monitoring the flow of fluid into interior volume 12 and confirming that the flow rate must indicate that all of the nozzle outlets are at least partially blocked by a respective plug. Those skilled in the art will appreciate that other alternative confirmation strategies, or none at all, may also be utilized. For instance, by closely monitoring the vacuum pressure within interior volume 12 as the nozzle tip 10 is inserted into vessel 25 one might be able to confirm that all the nozzle outlets are covered.

Figure 2:
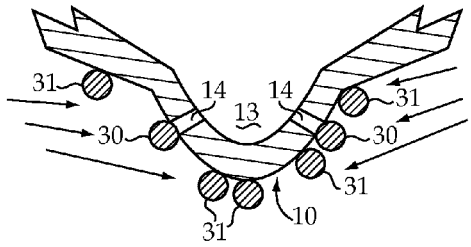
FIG. 2 is an enlarged sectioned side view of the sac area of the nozzle tip of FIG. 1 after the tip has been removed from the vessel of plugs.
Figure 3:
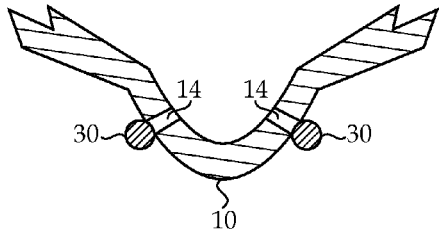
FIG. 3 is a view similar to FIG. 2 after surplus clinging plugs have been removed from the nozzle tip.

After a respective plug 30 has been suctioned over each of the plurality of nozzle outlets 14, the nozzle tip 10 may be removed from the vessel 25 to reveal a close up view as shown in FIG. 2. In particular, one could expect excess plugs 31 to cling to exterior surface 16 at locations away from nozzle outlets 14. Thus, a next step might include a strategy for removing at least some of the excess plugs 31 from the exterior surface 16 so that no excess plugs 31 can interfere with the subsequent portion of the procedure where the nozzle outlets 14 interact with an autofrettage fixture to seal the respective nozzle outlets 14. Thus, some dislodging means 29 may be utilized, which may include blowing air or some other fluid over the outer surface 16 of nozzle tip 10. Alternatively, or in addition, the dislodging means 29 may include some mechanical strategy, such as brushing the exterior surface to remove the excess plugs 31 to leave the nozzle tip 10 as shown in FIG. 3 with only a respective plug 30 suctioned over each of the nozzle outlets 14.

Figure 4:
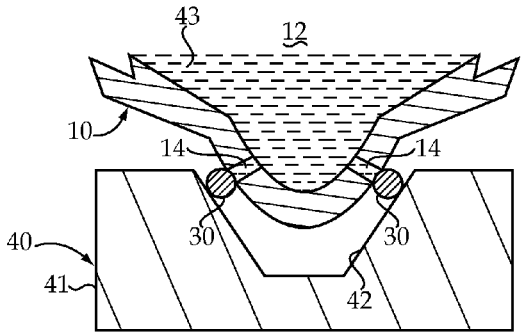
FIG. 4 is a sectioned side view of the nozzle tip of FIG. 3 in contact with an autofrettage fixture for evacuating voids from the interior volume of the nozzle tip.

Although there may be a respective plug suctioned over each nozzle outlet 14, the nozzle outlets may not be sealed. In addition, before pressurization for the autofrettage process commences, voids within interior volume 12 are preferably evacuated. One strategy for evacuating voids may be to maneuver the nozzle tip 10 into proximity of a base 41 of an autofrettage fixture 40 so that the individual plugs 30 are trapped between a contact surface 42 and the individual nozzle outlets 14 as shown in FIG. 4. At this point, if not already done, the interior volume 12 may be filled with autofrettage liquid. Voids within the interior volume may be evacuated by sequentially moving autofrettage liquid from interior volume 12, through each respective nozzle outlet 14 and past each respective plug 30. Alternatively, if the base 41 of autofrettage fixture 40 carries autofrettage liquid, the void evacuation strategy could be reversed such that autofrettage liquid is drawn sequentially past each respective plug 30, through each nozzle outlet 14 and into interior volume 12. In either case, evacuating voids may include moving autofrettage liquid past each respective plug 30 and through the respective nozzle outlet 14. Depending upon the strategy chosen, the vacuum may or may not be relieved on interior volume 12 at this point in the procedure.

Figure 5:
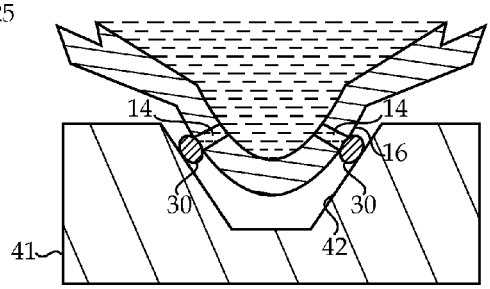
FIG. 5 is a sectioned side view similar to FIG. 4 after the plugs have been crushed to block the nozzle outlets of the nozzle tip.

When there is sufficient confidence that the voids within the interior volume 12 of nozzle tip 10 have been evacuated, the nozzle tip 10 may be fully engaged with the autofrettage fixture 40 by utilizing a clamping force 45 to press each respective plug 30 against the outer surface 16 of nozzle tip 10 at each respective nozzle outlet 14 via contact surface 42. Those skilled in the art will appreciate that the base 41 of autofrettage fixture 40 may include a cup shaped cavity that is defined by contact surface 42. Contact surface 42 may have a contour that closely matches the contours of exterior surface 16 in the vicinity of nozzle outlets 14, or may have a frustoconical shape. Each of the nozzle outlets 19 are blocked, but not necessarily sealed, by pressing the respective plugs against the nozzle outlets. When this is done, the individual plugs 30 may deform and block the nozzle outlets 14 as shown in FIG. 5. Thus, one strategy for blocking the nozzle outlets includes crushing each respective plug between the nozzle tip 10 and an autofrettage fixture component 41.

Figure 6:
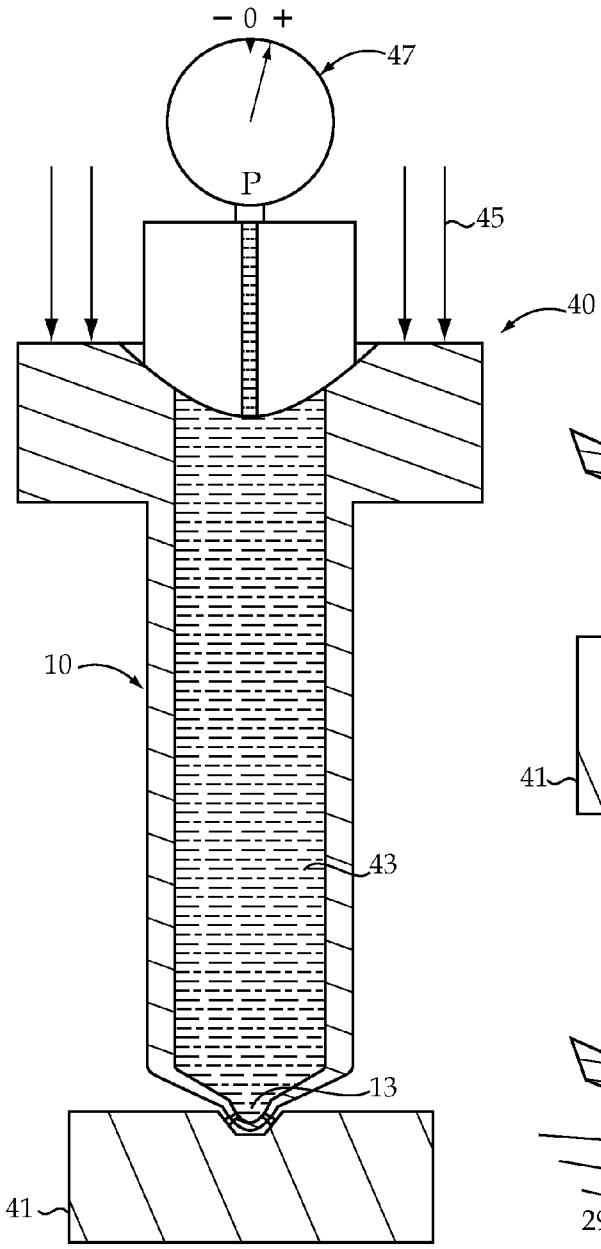
FIG. 6 is a full size view of the nozzle tip during the autofrettage pressurization process.

After the nozzle outlets 14 are blocked and any voids within the interior volume 12 have been evacuated, and after the interior volume is filled with autofrettage liquid, the autofrettage pressurization process is ready to begin. In this case, a hypothetical pressure gauge 47 is included as shown in FIG. 6 to show that the autofrettage liquid 43 is pressurized to an autofrettage pressure level that is chosen based upon a variety of factors, including the material thickness in sac region 13, the material out of which nozzle tip 10 is made, the depth to which the compressive residual stress is desired and many other factors known in the art. The interior volume may remain pressurized to autofrettage pressure levels for a duration that causes plastic deformation of the material in the sac region while only elastic deformation of the material surrounding the sac at the outer surface 16 of nozzle tip 10.

Figure 7:
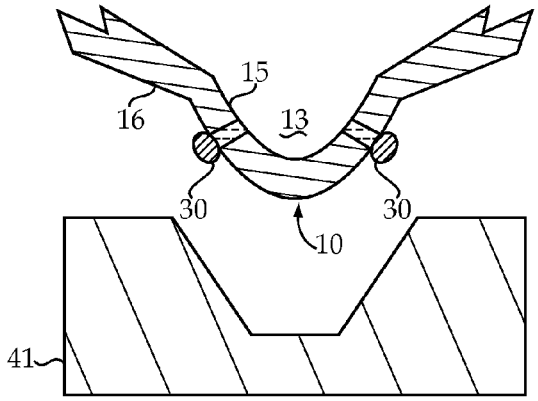
FIG. 7 is an enlarged view of the sac portion of the nozzle tip during removal from the autofrettage fixture of FIG. 6.
Figure 8:
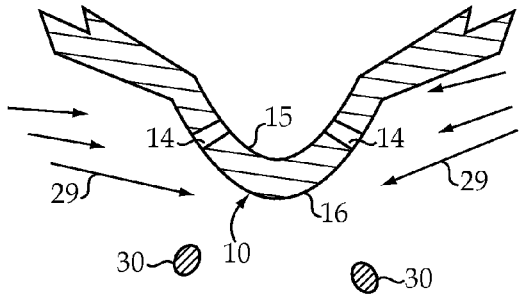
FIG. 8 is a side view similar to that of FIG. 7 showing the plugs being removed from the nozzle tip to complete the nozzle tip strengthening procedure.

Next, the autofrettage pressure is relieved and the nozzle tip 10 is disengaged from base 41 of autofrettage fixture 40 as shown in FIG. 7. The autofrettage liquid may be drained out of nozzle tip 10 by any suitable manner. At this point, the respective plugs 30 may or may not fall free from nozzle tip 10. If required, some dislodging means 29, such as a brush or blowing air may be employed to remove the plugs 30 after the autofrettage process as shown in FIG. 8. If in a production setting, the robotic arm, not shown, might deposit the autofrettaged nozzle tip for subsequent processing and return to retrieve a new nozzle tip 10 for processing as illustrated in FIGS. 1-8.

Although the autofrettage process has been discussed with regard to strengthening the sac region of the nozzle tip 10, similar compressive residual stress may be provided in the cylindrical bore leading to the sac region during the autofrettage process. In other words, plastic deformation may occur in the interior surface 15 in the cylindrical bore portion while only elastic deformation occurs in the region near the exterior surface 16, resulting in compressive residual stress in the interior portion of the nozzle tip 10. Thus the cylindrical bore portion of the nozzle tip may be strengthened in this pressure sensitive region as well.

INDUSTRIAL APPLICABILITY

The present disclosure finds potential application in strengthening a pressure vessel component via an autofrettage process when the component includes at least one outlet. The disclosure is specifically applicable to those pressure vessels in which the component is not modified or otherwise machined to include a seating surface around the nozzle outlet to better facilitate a conventional ball and conical seat sealing strategy. Finally, the present disclosure is specifically applicable to fuel injector nozzle tips in which a plurality of microscopic nozzle outlets are distributed at different locations and are in need of being sealed for an autofrettage process. In addition, the process of the present disclosure may be generally applicable for factory based mass processing of many nozzle tips for strengthening purposes. The present disclosure is specifically applicable to strengthening nozzle tips that must undergo reliable operation at cyclic or continuous high pressures on the order of 240 MPa or higher. Thus, the process of the present disclosure is particularly applicable to blocking uncontrolled convex surfaces through which microscopic holes open, as is typical in the case of a fuel injector nozzle outlet tip 10.

The process of the present disclosure has the advantage of allowing a nozzle tip autofrettage process without requiring extra machining steps or the like to prepare the outer surface of the nozzle tip for sealing in order to undergo the autofrettage pressurization. While the nozzle outlets could conceivably be blocked by the outer surface of the injector tip being precision ground and then precision tooling being match ground to match the tip precision outer surface, such a strategy would not likely be production robust. The present process may be robust since a relatively blind process can be utilized for plugging and sealing the individual nozzle outlets prior to autofrettage pressurization.

Although the present disclosure contemplates microspheres that are soft relative to the hard material of the nozzle tip, those skilled in the art will appreciate that other shaped plugs are also contemplated. In addition, a lack of spheroidal shapes could be compensated by a more softer plug material. With regard to extra plugs 31 that might adhere to the outer surface of the nozzle tip, those skilled in the art will appreciate that their removal may only be necessary to the extent that they are in a location that could interfere with the engagement between the nozzle tip and the autofrettage fixture in a way that could undermine the sealing ability of the plugs 30 that are at the desired locations over the nozzle outlets 14. In addition, those skilled in the art would appreciate that the brushing or blowing or otherwise removing excess plugs 31 should not be too aggressive so as to possibly dislodge properly positioned plugs 30 that are located covering a nozzle outlet 14. Although the used plugs 30 are shown in the illustrations as being blown or brushed free from the nozzle tip after the autofrettage pressurization, those skilled in the art will appreciate that a pressure differential between the interior volume 12 and the exterior of the nozzle tip 10 could also be exploited to aid in removing the used plugs 30 without departing from the present disclosure.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A method of strengthening a nozzle tip, comprising the steps of:

applying a vacuum to an interior volume of the nozzle tip;

suctioning a respective plug over each of a plurality of nozzle outlets located at the tip during the applying step;

blocking the each of the plurality of nozzle outlets with the respective plug; and autofrettaging the nozzle tip at least in part by pressurizing the interior volume with autofrettage liquid.

2. The method of claim 1 including a steps of:

inserting the nozzle tip into a vessel of plugs during the applying step; and removing the nozzle tip from the vessel.

3. The method of claim 2 including loading the vessel with spherical plugs that are larger in diameter than a diameter of each nozzle outlet at an outer surface of the nozzle tip.

4. The method of claim 3 including sizing the spherical plugs to have a diameter less than two times the diameter of each nozzle outlet at the outer surface of the nozzle tip.

5. The method of claim 4 wherein the sizing step includes sizing the spherical plugs to have a diameter at least twenty percent greater than the diameter of each nozzle outlet at the outer surface of the nozzle tip.

6. The method of claim 5 wherein the loading step includes spherical plugs made of a material that is softer than a material of the nozzle tip.

7. The method of claim 6 including evacuating voids from the interior volume with autofrettage liquid.

8. The method of claim 7 wherein the evacuating step includes moving autofrettage liquid past each respective plug and through the respective nozzle outlet.

9. The method of claim 8 wherein the moving step includes moving autofrettage liquid sequentially from the interior volume, through each respective nozzle outlet and past each respective plug.

10. The method of claim 8 wherein the moving step includes moving autofrettage liquid sequentially past each respective plug, through each respective nozzle outlet and into the interior volume.

11. The method of claim 4 wherein the sealing step includes pressing each respective plug against an outer surface of the nozzle tip at a respective nozzle outlet.

12. The method of claim 11 wherein the sealing step includes deforming each respective plug at the respective nozzle outlet.

13. The method of claim 11 wherein the sealing step includes crushing each respective plug between the nozzle tip and an autofrettage fixture component.

14. The method of claim 1 including a step of removing excess plugs clinging to an outer surface of the nozzle tip prior to the autofrettaging step.

15. The method of claim 14 wherein the removing step includes brushing the excess plugs off of the nozzle tip.

16. The method of claim 14 wherein the removing step includes blowing the excess plugs off of the nozzle tip.

17. The method of claim 1 including a step of removing the plugs from the nozzle tip after the autofrettaging step.

* * * * *